US005197256A

United States Patent [19]

Martin

[11] Patent Number: 5,197,256

[45] Date of Patent: Mar. 30, 1993

[54] PANEL CONSTRUCTION

[75] Inventor: David B. Martin, Jenison, Mich.

[73] Assignee: Herman Miller, Inc., Zeeland, Mich.

[21] Appl. No.: 713,033

[22] Filed: Jun. 7, 1991

Related U.S. Application Data

[63] Continuation of Ser. No. 524,323, May 15, 1990, abandoned, which is a continuation-in-part of Ser. No. 336,850, Apr. 12, 1989, abandoned.

[51] Int. Cl.[5] ..... E04C 2/36; B32B 3/12

[52] U.S. Cl. ..... 52/808; 52/809; 428/116

[58] Field of Search ..... 52/406, 806, 808, , 52/809, 799, 800, 801, 807; 428/116, 117, 118

[56] References Cited

U.S. PATENT DOCUMENTS

| | | | |
|---|---|---|---|
| 1,159,411 | 11/1915 | Olberg . | |
| 1,875,888 | 9/1932 | Richardson . | |
| 2,302,487 | 11/1942 | Beiger et al. | 52/807 |
| 2,399,666 | 5/1946 | Een . | |
| 2,664,596 | 1/1954 | Greig . | |
| 2,757,116 | 7/1956 | Clements . | |
| 2,876,053 | 3/1959 | Eves | 52/806 |
| 3,228,822 | 1/1966 | Norman . | |
| 3,252,262 | 5/1966 | Jessen | 52/806 |
| 3,299,595 | 1/1967 | Munk . | |
| 3,763,612 | 10/1973 | Saino . | |
| 3,906,127 | 9/1975 | Hollman et al. . | |
| 4,084,366 | 4/1978 | Saylor et al. | 52/809 |
| 4,343,846 | 8/1982 | Kohn | 428/116 |
| 4,373,313 | 2/1983 | Nash, Jr. | 52/799 |
| 4,643,933 | 2/1987 | Picken | 428/116 |

FOREIGN PATENT DOCUMENTS

| | | | |
|---|---|---|---|
| 603122 | 8/1960 | Canada | 52/799 |
| 1104490 | 6/1954 | France . | |
| 434420 | 8/1935 | United Kingdom | 52/800 |

*Primary Examiner*—Michael Safavi

*Attorney, Agent, or Firm*—Varnum, Riddering, Schmidt & Howlett

[57] ABSTRACT

A structural panel comprising a hollow frame defining a central opening, with the frame having secured to opposite sides thereof first and second facing panels. The opening within the frame receives a core which is of the same thickness as the frame, but which has a perimeter less than that defined by the opening so that the core is loosely positioned within the opening. The core is supported solely by the facing panels and is free of any direct connection to the frame, the core being connected to the frame only through the facing panels.

16 Claims, 1 Drawing Sheet

PANEL CONSTRUCTION

This is a continuation of application Ser. No. 07/524,323, filed May 15, 1990, now abandoned, which is a continuation-in-part of application Ser. No. 07/336/850, filed Apr. 22, 1989, now abandoned.

FIELD OF THE INVENTION

The present invention relates in general to new and useful improvements in structural panels, and more particularly to a panel which is adapted for use in doors, shelves, "modular" freestanding partitions and the like, and is of sufficient rigidity to resist warping of the panel.

BACKGROUND OF THE INVENTION

It is known to form rigid panels of hollow frames, cores positioned within the frames and outer facing panels adhesively bonded to opposite sides of the frame and the core. It is also known to provide peripheral trim bonded to edges of both the frame and the facing panels.

SUMMARY OF THE INVENTION

In accordance with the present invention, it has been found desirable to provide a core which is of a size smaller than inner dimensions of the frame so that the core peripheral edges can be spaced inwardly of at least two sides of the frame and is supported solely by the facing panels which are bonded both to the frame and to the core. By such construction, the panel of the invention not only has the advantage of providing a relatively light weight, rigid, thin panel which will resist warping, but it is also associated with other advantages as a result of the above-described relative dimensions of the core and frame. First, assembly of the frame and the core is relatively simple in that the frame is first placed on its side and the core is then merely dropped into the frame. Second, in manufacturing the frame, one need not maintain close tolerances between the internal and external dimensions of the frame and the core. Third, one step in the assembly process is eliminated. Only one securing step is required to assemble the core, the frame and the outer facing panels. The step of directly securing the frame to the core is eliminated.

BRIEF DESCRIPTION OF THE DRAWINGS

Reference will now be made to the drawings in which.

DESCRIPTION OF THE PREFERRED EMBODIMENTS

Figure 1:
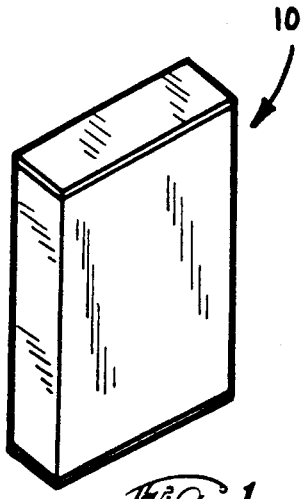
FIG. 1 is a perspective view of a structure panel formed in accordance with the invention.

Referring now to the drawings in detail, there is illustrated a rectangular panel 10 formed in accordance with the invention. As stated above, the panel 10 can be useful in the construction of freestanding partition walls of the type found in "modular" office systems. The panel 10 may also be useful in the construction of shelving, doors and other similar articles where it is desirous to provide a rigid panel or wall construction resistant to warping.

Figure 2:
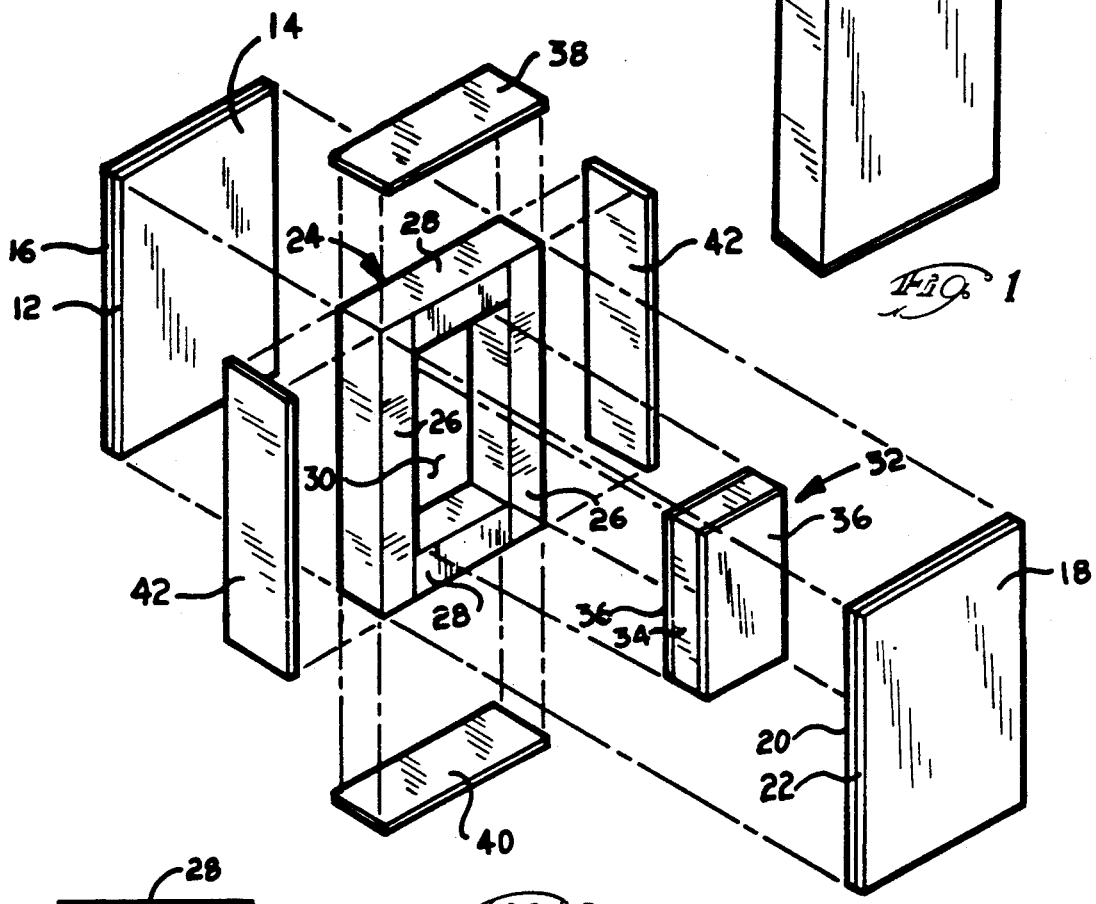
FIG. 2 is an exploded perspective view thereof.

As shown in FIG. 2, panel 10 comprises facing means forming opposite front and rear sides of the panel. The facing means comprises a first facing panel 12 of two-ply construction including an inner hardboard layer 14 to which there is adhesively bonded an outer finish layer 16. Preferably, the finish layer 16 is formed of a wood veneer, although it could be in the form of a decorated plastic sheet or a fabric covering. The facing means further comprises a second facing panel 18 which is preferably of the same construction as the first facing panel 12 and includes an inner hardboard layer 20 which has adhesively bonded thereto an outer layer 22 which is preferably in the form of wood veneer.

The panel 10 further includes a central frame 24 which is preferably formed of particle board and includes a pair of stiles 26 joined together by a pair of rails 28. Any suitable securing means, such as stapling, can be used to join the stiles and the rails.

Figure 3:
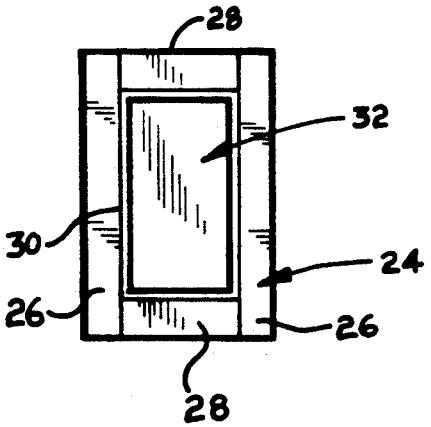
FIG. 3 is a top plan view thereof, illustrating partial assembly of the panel.

The frame 24 defines an opening 30 which receives a core generally identified by the numeral 32. The core 32 is of the same thickness as the frame 24, but overall is of a peripheral outline substantially less than that of the opening 30 whereby the core is supported independent of the frame 24. Specifically, the area defined by the peripheral edges of the core is substantially less than that defined by the opening so that the core can be received within the frame without touching the sides of the frame. Thus, a structural panel according to the invention includes a core having a plurality of peripheral edges wherein at least two of the peripheral edges are spaced inwardly from the frame. It is possible for the core to be positioned within the opening such that the core engages two adjacent frame sides, thereby leaving at least two of the core edges spaced inwardly from the frame. The core includes a pair of opposed vertical peripheral edges, each of which can be adjacent to and spaced inwardly from one of the pair of stiles or vertical frame ends. Similarly, the core includes a pair of opposed horizontal peripheral edges, each of which can be adjacent to and spaced inwardly from one of the pair of rails or horizontal frame ends. As best shown in FIG. 3, the core has peripheral edges which can be spaced inwardly from the frame whereby a substantially open and continuous channel separates the core and the frame. However, in actual practice, one or two of the core peripheral edges may contact the frame.

The core 32 is of a laminated construction, including a central honeycomb layer 34 which is preferably formed of paper, and a pair of exterior skins 36 which are preferably formed of a galvanized steel. The core 32 of the type just described is currently commercially available from International Honeycomb Corporation of University Park, Ill.

The panel 10 further includes an upper trim piece or strip 38, a lower trim strip 40 and a pair of side trim strips 42. The trim strips 38, 40, 42 are preferably formed of wood veneer and are bonded to edges of the assembled frame and first and second facing panels 12, 18.

Figure 4:
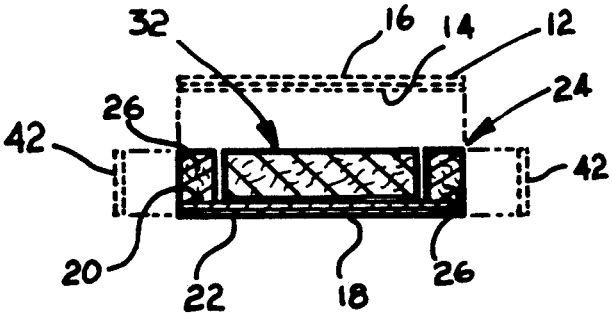
FIG. 4 is a sectional view thereof taken along line 4—4 of FIG. 3, illustrating further details of the assembly by way of dotted lines.

In assembling the panel 10, the first facing panel 12 is aligned with and secured to one side of the frame 24. The securing step is accomplished with an adhesive bond. the core 32 is then positioned within the opening 30 in spaced relationship to the stiles 26 and the rails 28, as best illustrated in FIG. 3, although the core can contact one stile 26 and/or one rail 28. The core 32 is subsequently adhesively bonded to the inner layer 14 of the first facing panel 12. Subsequently, the inner layer 20 of the second facing panel 12 is coated with an adhesive (not shown) and pressed against both the frame 24 and the core 32 as diagrammatically shown in FIG. 4. The panel 10 is then completed by applying adhesive to the trim strips 38, 40, 42 and applying the strips to edges of the thus formed panel 10. Any suitable adhesive may be employed in the construction of the panel 10 as heretofore described. For example an adhesive sold under the trademark Woodloc, by National Starch and Chemical Corporation of Chicago, Ill., may be used.

The panel 10 differs from other structural panels in that the core 32 is of a significantly smaller periphery than the opening 30 in the frame and is mounted independent of the frame by being adhesively bonded directly to the first and second facing panels 12, 18 and being secured to the frame 24 only through the facing panels.

Only a preferred embodiment of the panel has been specifically illustrated and described herein. It is to be understood, however, that minor variations may be made in the panel without departing from the spirit and scope of the invention as defined in the appended claims.

I claim:

1. In a structural panel comprising a frame, a core and facing means, said frame defining an opening and having opposite frame sides and pairs of vertical and horizontal frame ends, said core being positioned in said opening, having opposite core sides and having four peripheral edges, said facing means being mounted on said opposite frame and core sides for providing opposite front and rear surfaces of said panel; the area defined by the peripheral edges of said core is sufficiently less than that defined by said frame opening so that at least two peripheral edges of said core are spaced inwardly from said frame, the thickness of said core is substantially equal to that of said frame, so that said frame sides are positioned in the same planes as said core sides, and said core is secured to said facing means, the improvement which comprises:

said core comprises a honeycomb center and metal skins on opposite sides of the honeycomb center; and wherein said core is fixed relative to said frame solely by said facing means.

2. A panel according to claim 1, wherein said facing means comprises a pair of first and second facing panels secured to said opposite frame and core sides.

3. A panel according to claim 2, wherein said first and second facing panels are identical and each comprises a first layer mounted on and covering the respective sides of said frame and said core.

4. A panel according to claim 3, wherein each of said first and second facing panels further comprises a second layer secured to and covering the respective first layer.

5. A panel according to claim 4, and further comprising a trim piece mounted on and covering each of said vertical and horizontal frame ends.

6. A panel according to claim 1, wherein said frame further comprises pairs of vertical and horizontal stiles and rails, respectively, made of particle board.

7. A panel according to claim 3, wherein said first layer of each of said first and second facing panels is formed of a hardboard sheet.

8. A panel according to claim 4, wherein said second layer of each of said first and second facing panels is formed of a veneer sheet.

9. A panel according to claim 5, wherein said trim piece is formed of a veneer sheet.

10. A panel according to claim 1, wherein said honeycomb center is formed of paper.

11. A panel according to claim 1 wherein said core peripheral edges include a pair of opposed vertical edges, each edge being adjacent to and spaced inwardly from one of said pair of vertical frame ends.

12. A panel according to claim 11 wherein said core peripheral edges further comprise a pair of opposed horizontal edges, each edge being adjacent to and spaced inwardly from one of said pair of horizontal frame ends.

13. A panel according to claim 1 wherein said core peripheral edges include a pair of opposed horizontal edges, each edge being adjacent to and spaced inwardly from one of said pair of horizontal frame ends.

14. A panel according to claim 1 wherein said core peripheral edges are all spaced inwardly from the frame whereby a substantially open and continuous channel separates the core and the frame.

15. In a structural panel comprising a frame, a core and facing means, said frame defining an opening and having opposite frame sides, said core being positioned in said opening and having opposite core sides, said facing means being mounted on and secured to said opposite frame and core sides for providing opposite front and rear surfaces of said panel, the improvement which comprises:

said core comprises a honeycomb center formed of paper and metal skins on opposite sides of the honeycomb center; and wherein said core is fixed relative to said frame solely by said facing means.

16. In a structural panel comprising a frame, a core and facing means, said frame defining an opening and having opposite frame sides and pairs of vertical and horizontal frame ends, said core being positioned in said opening, having opposite core sides and having four peripheral edges, said facing means being mounted on said opposite frame and core sides for providing opposite front and rear surfaces of said panel; the area defined by the peripheral edges of said core is sufficiently less than that defined by said frame opening so that at least two peripheral edges of said core are spaced inwardly from said frame, the thickness of said core is substantially equal to that of said frame, so that said frame sides are positioned in the same planes as said core sides, and said core is secured to said facing means, the improvement which comprises:

said core comprises a honeycomb center and metal skins on opposite sides of the honeycomb center; and said frame further comprises pairs of vertical and horizontal stiles and rails, respectively, made of particle board.

* * * * *